US005511712A

United States Patent [19]

Holm et al.

[11] Patent Number: 5,511,712

[45] Date of Patent: Apr. 30, 1996

[54] WEB GUIDE ROLLER WITH DIRECTIONALLY SWITCHED DRIVE COUPLING

[75] Inventors: Helmut Holm, Erlabrunn; Volker G. Rauh, Hettstadt; Karl-Heinz A. Schneider, Würzburg, all of Germany

[73] Assignee: Koenig & Bauer Aktiengesellschaft, Wurzburg, Germany

[21] Appl. No.: 346,294

[22] Filed: Nov. 23, 1994

[30] Foreign Application Priority Data

Nov. 23, 1993 [DE] Germany ..... 43 39 766.2

[51] Int. Cl.[6] ..... B65H 43/00; B65H 20/02; B41F 13/54

[52] U.S. Cl. ..... 226/11; 101/228; 101/484; 226/108; 226/183

[58] Field of Search ..... 226/11, 178, 35, 226/189, 191, 108, 183; 242/419.4, 419.5; 101/217, 219, 228, 484

[56] References Cited

U.S. PATENT DOCUMENTS

| | | | |
|---|---|---|---|
| 3,375,716 | 3/1968 | Lawrie et al. | 226/35 X |
| 3,409,237 | 11/1968 | Pospisil et al. | 226/11 X |
| 4,398,877 | 8/1983 | Taylor | 226/108 X |
| 4,508,033 | 4/1985 | Fischer | 101/217 |
| 4,549,485 | 10/1985 | Narwrath | 226/11 X |
| 5,163,371 | 11/1992 | Kotterer et al. | 226/11 X |
| 5,398,610 | 3/1995 | Paviliny et al. | 226/11 X |

FOREIGN PATENT DOCUMENTS

| | | |
|---|---|---|
| 558071 | 8/1932 | Germany . |
| 1230642 | 12/1966 | Germany . |
| 8915572.6 | 10/1990 | Germany . |

*Primary Examiner*—Michael R. Mansen
*Attorney, Agent, or Firm*—Jones, Tullar & Cooper

[57] ABSTRACT

Damage to rotating cylinders in a web-fed rotary printing machine, due to breaks or tears in the material web passing through the machine, is prevented by providing a web guide roller with a directionally switched coupling intermediate two spaced gripping locations. If the web breaks, the web guide roller becomes positively driven and prevents web roll up on one of the rotating cylinders.

9 Claims, 3 Drawing Sheets

WEB GUIDE ROLLER WITH DIRECTIONALLY SWITCHED DRIVE COUPLING

FIELD OF THE INVENTION

The present invention is directed generally to a device for preventing damage to production apparatus in cases of tears or breaks in a material web. More particularly, the present invention is directed to a device for preventing damage to production apparatus having rotating cylinders which is caused by torn material webs. Most specifically, the present invention is directed to a device for preventing damage to production apparatus with rotating cylinders, such as blanket cylinder in a web-fed rotary printing press, by torn printed paper webs. The material web passes around a rotatably supported web guide roller which is located intermediate, in the direction of web travel, first and second spaced web gripping locations. The material web is pressed against the surface of the web guide roller by pressure rollers. The web guide roller is frictionally driven by the material web until such time as the web may break or tear. Upon such a web break or tear occurring, a directionally switched coupling takes over the drive of the web guide roller.

DESCRIPTION OF THE PRIOR ART

In web fed rotary printing presses, an endless material web, such as an endless web of paper being printed by the press, is fed through various printing couples and about other rollers and cylinders at a high rate of speed. Although web breaks and tears do not happen too frequently, when one does occur, it may cause significant damage to the printing press and may also result in substantial press down time. If a material web breaks between two web gripping locations, the tension is removed from the web. Once this tension has been removed, the web will be apt to roll up on the upstream cylinders or rollers which formed the first web gripping pair. Such an accumulation of the paper web on one of these rollers or cylinders increases the effective diameter of the roller or cylinder. It will be apparent that such an increase in cylinder size will exert possibly destructive forces on the cylinder shafts, bearings, supports and possibly even on the press frame.

One prior art device which has attempted to prevent damage to production apparatus with rotary cylinders in the event of a material web tear or break is shown in German Patent DE-PS 558,071. In this prior device, the conveying speed of the torn paper web is a function of the centrifugal mass of the two cylinders involved. With the employment of this device downstream from an offset printing unit in particular, it is impossible to prevent the web from becoming rolled up on the blanket cylinder in cases of a web tear or break. This winding up of the web on the blanket cylinder can cause the types of damage to the printing unit discussed above.

A need exists for a device which prevents damage to rotating cylinders in cases of paper web tears or breaks. The torn material web damage preventing device of the present invention provides such a device and is a substantial improvement over the prior art devices.

SUMMARY OF THE INVENTION

It is an object of the present invention to provide a device for preventing damage to production apparatus in case of breaks or tears in a material web.

Another object of the present invention is to provide a device for preventing damage to rotating cylinders caused by torn material webs.

A further object of the present invention is to provide a device for preventing damage to blanket cylinders in a rotary web-fed printing press caused by torn paper webs.

Still another object of the present invention is to provide a torn material web damage prevention device which uses a web guide roller.

Yet a further object of the present invention is to provide a damage prevention device having a guide roller including a directionally switched coupling.

Even yet another object of the present invention is to provide a web guide roller with a torque switched coupling to an external drive source.

As will be discussed in detail in the description of the preferred embodiment which is presented subsequently, the torn material web damage prevention device in accordance with the present invention utilizes a web guide roller which is situated in a path of paper web travel intermediate first and second web gripping locations. These two web gripping locations are typically cooperating rotating cylinder pairs. The web guide roller supports the paper web and in normal operation is driven by frictional contact with the paper web which is forced against the surface of the web guide roller by spaced resilient pressure rollers. The web guide roller is rotatably supported on a central, driven shaft by a directionally switched coupling. The web guide roller drive shaft is driven by an external drive source through a torque switched coupling. In the event of a web break or tear intermediate the two gripping locations, and downstream of the web guide roller, the paper web tension will be significantly reduced. The rotational speed of the exterior surface of the web guide roller will drop. This will cause the directionally switched coupling to drivingly connect the guide roller drive shaft to the guide roller outer body thus maintaining tension in the material web and preventing web build up on the rotating cylinders upstream of the web guide roller.

A particular advantage of the torn material web damage preventing device in accordance with the present invention is that the end of the torn material web exiting the first gripping location will continue to be conveyed in a controlled manner until the conveying cylinders can be stopped. By selecting a known difference in the revolutions between the paper web guide cylinder and a directionally switched coupling downstream from it, which may be, for example, a free wheeling gripping roller provided with a driving spring holder, it is possible to determine quite accurately by how many centimeters the separated end is to be maximally pulled back from the conveying cylinder until the device operates.

The torn material web damage prevention device in accordance with the present invention overcomes the limitations of the prior art devices. It is a substantial advance in the art.

BRIEF DESCRIPTION OF THE DRAWINGS

While the novel features of the torn material web damage prevention device in accordance with the present invention are set forth with particularity in the appended claims, a full and complete understanding of the subject invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
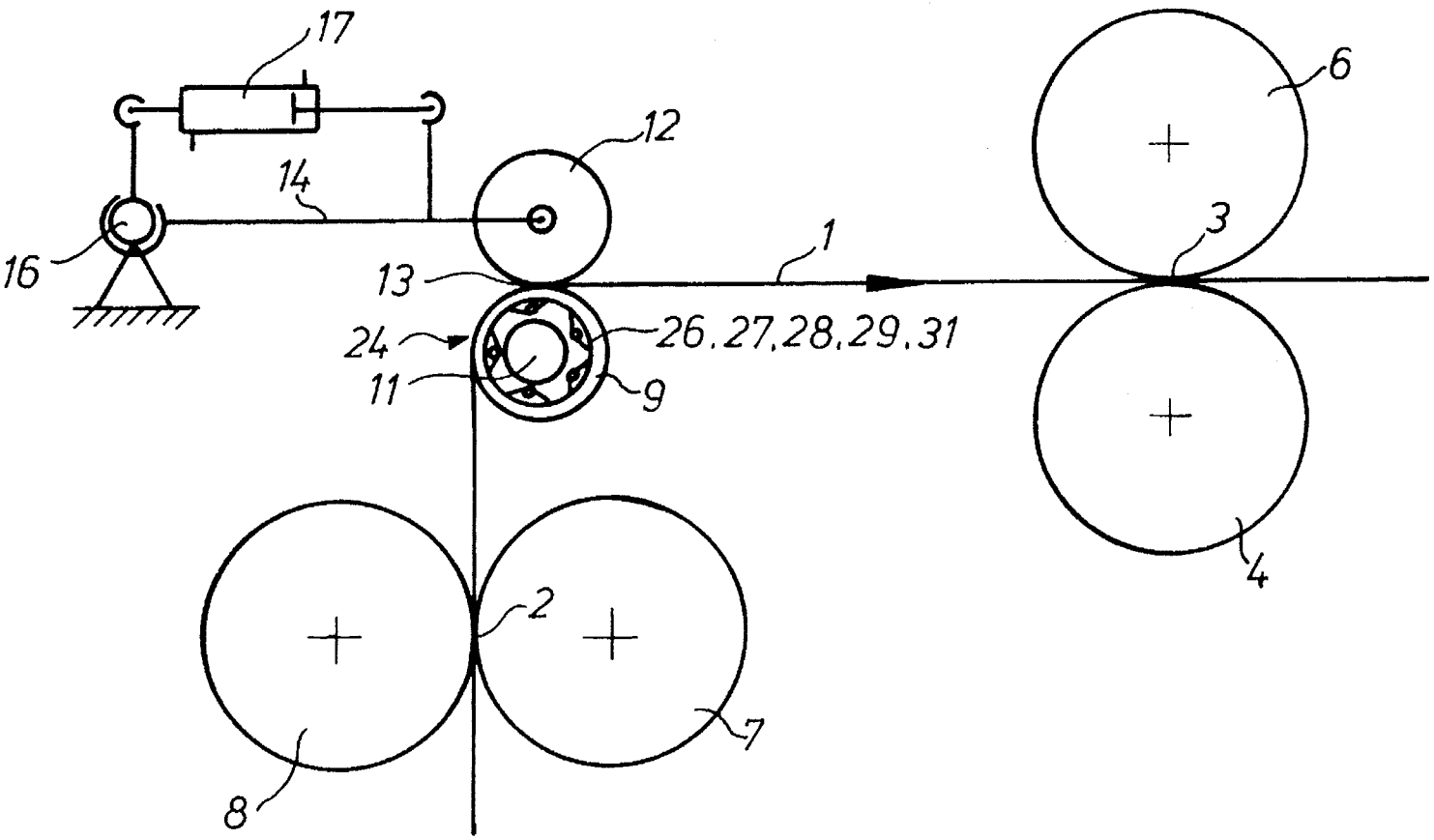
FIG. 1 is a schematic side elevation view of the torn material web damage prevention device in accordance with the present invention.

Referring initially to FIG. 1, there may be seen in somewhat schematic form a preferred embodiment of a torn material web damage prevention device in accordance with the present invention. As may be seen in FIG. 1, a material web 1, which is preferably a paper web in a web-fed rotary offset printing press, is transported under a defined paper web tension between first and second paper web gripping locations 2 and 3, respectively. The direction of paper web transport is indicated by the arrow on the paper web 1, as shown in FIG. 1. Thus the gripping location 2 may be designated as the upstream web gripping location and the gripping location 3 may be designated as the downstream web gripping location. Each of these two web gripping locations 2 and 3 are formed by two cooperating rotating cylinders 7,8 and 4,6, respectively. The two cylinders 4 and 6 in the second or downstream gripping location are preferably blanket cylinders of the web-fed rotary printing press.

A web guide roller, generally at 9, is situated between the upstream and downstream web gripping locations 2 and 3. In accordance with the present invention, this web guide roller 9 has the function of a draw-off roller which is supported on a shaft 11. This web guide roller constitutes a further or third material web 1 gripping location 13. The material web 1 is held against the outer surface of the web guide roller 9 by a plurality of axially spaced resilient pressure rollers 12. These resilient pressure rollers 12 are pressed against the surface of the web guide roller 9 with a defined force. At least two such resilient pressure rollers 12 are placed axially along the length of the web guide roller 9. As may be seen in FIG. 2, three such resilient pressure rollers 12 are utilized in the present invention. It will be understood that a cylinder could be used in place of the pressure rollers 12.

Each pressure roller 12 is rotatably supported at a first, outer end of a lever arm 14, as shown most clearly in FIG. 1. An inner end of each such lever arm 14 is pivotably and axially displaceably supported about a spindle 16 which extends parallel to the axis of rotation of the web guideroller 9. This spindle 16 is secured to the frame of the web-fed rotary printing press. A pneumatic cylinder, generally at 17, as may also be seen in FIG. 1 is connected at an outer end to the lever arm 14 and at an inner end to the spindle 16. By charging each of these pneumatic cylinders 17 with a specific charge, a defined force may be applied by each pressure roller 12 to the web guide roller 9 in the direction toward the center of rotation of the web guide roller 9. This force presses the material web 1 against the web guide roller's surface with a pre-determined force. This cooperation of the web guide roller 9 and its associated pressure rollers 12 forms the third material web gripping location 13 which is intermediate the first and second gripping locations 2 and 3. The material web 1 will be dependably transported by friction at this third gripping location 13 and will cause the outer cylinder body of the web guide roller 9 to rotate. The force applied to the paper web 1 at this third gripping location 13 is generally constant, and is independent of changes in the centers of the rollers 12 and the web guide cylinder 9.

Each lever arm 14 can be pivoted about its inner end on spindle 16 by actuation of the pneumatic cylinder 17 to move its associated rotatably supported pressure roller 12 out of contact with the web guide roller 9. This will create a gap between the pressure rollers 12 and the web guide roller 9. Such a gap is necessary, for example, when a new material web 1 is being drawn into and through the web-fed rotary printing press.

Figure 2:
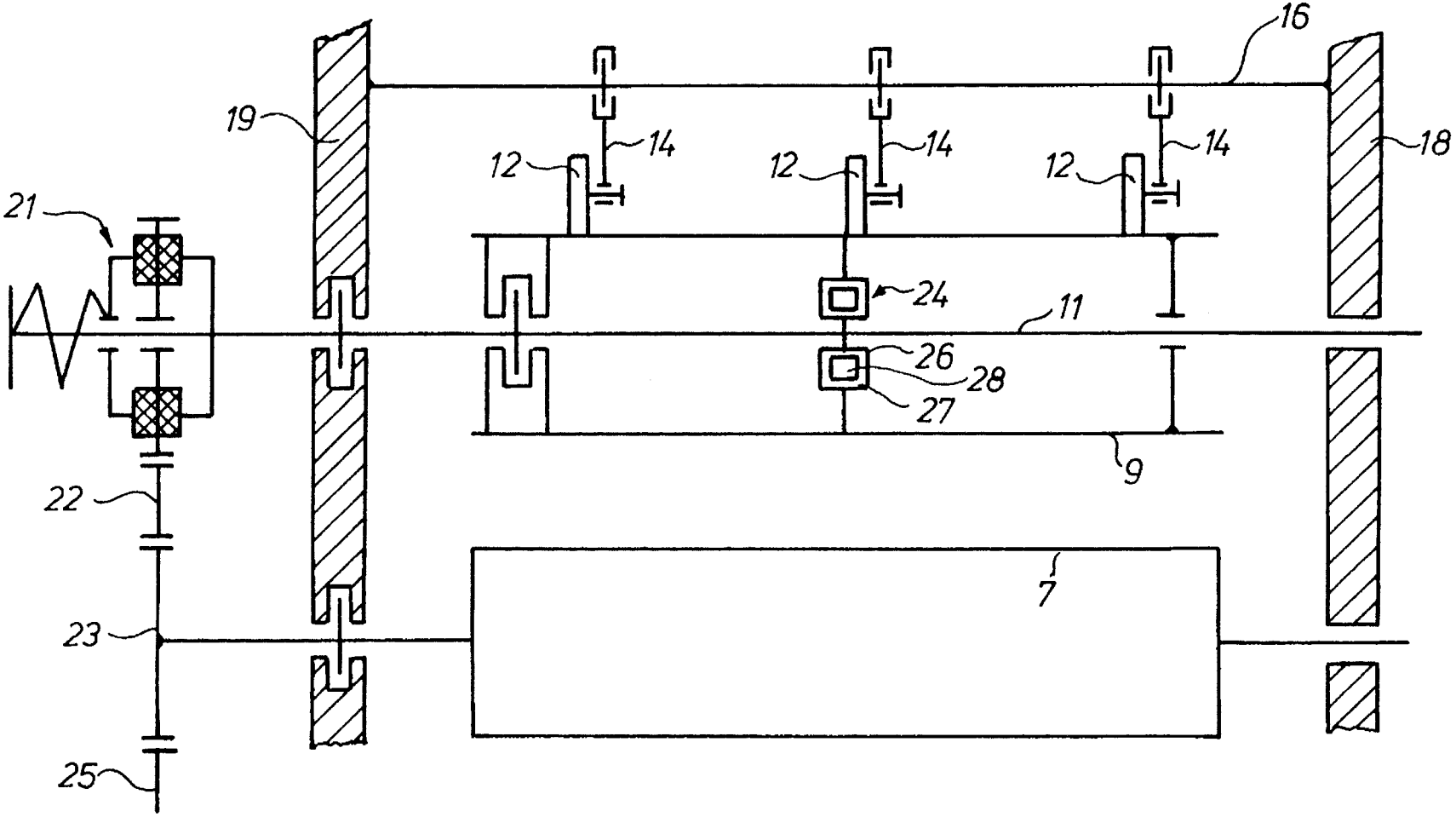
FIG. 2 is a schematic view, partly in cross-section, and showing the web guide roller and its associated drive element together with the pressure rollers associated with it.

Turning now primarily to FIG. 2, it may be seen that web guide roller 9 is supported by a driven roller support shaft 11 which is rotatably supported between the spaced side frames 18 and 19 of the printing press. The web guide roller 9 can accomplish a rotating movement with respect to the driven shaft 11 by operation of a direction switching coupling, generally at 24, as will be discussed in detail shortly. The web guide roller support shaft 11 is driven at one end by a drive element or arrangement, which is depicted somewhat schematically in FIG. 2. A torque switched coupling 21 is attached to an end of the roller drive shaft 11 exterior of the side frame 19. An intermediate wheel 22 engages the torque switched coupling 21 and turns it. This intermediate wheel 22 is driven by a cylinder drive wheel 23 from a main drive wheel 25 which is being driven through the main press drive (not shown).

When the web-fed rotary printing press of the present invention is in its normal operational mode during production, the web guide roller 9 is driven at the speed of the material web 1 by frictional contact with the web 1 which is pressed against the outer cylindrical surface of the guide roller 9 through web tension and the pressure rollers 12. Because of the operation of the direction controlled coupling 24, which will be discussed in detail shortly, there is no transfer of rotational force from the driven shaft 11 to the web guide roller 9 during the normal operational state of the printing press. This direction controlled coupling 24 allows the web guide roller 9 to turn independently of, and in the same direction as, the shaft 11 until the rotational speed of the web guide roller 9 becomes equal to, or less than that of the web guide roller drive shaft 11 which is being driven by the torque control coupling 21. To insure the independent rotation of the web guide roller 9 during normal production, the drive shaft 11 is driven at a lower rotational speed than the rotational speed imparted to the web guide roller 9 by the material web 1 passing around it.

If the material web 1 passing between the upstream and downstream gripping locations 2 and 3 should tear or break at a location intermediate the web guide roller 9 and the downstream or second gripping location 3, the tension in the web 1 passing over the web guide roller 9 will be reduced. This reduction in tension, and also the associated reduction in web travel speed, will cause a reduction in the rotational speed of the web guide roller 9. Once the rotational speed of the web guide roller 9 has fallen to that of the drive shaft 11, the direction controlled coupling 24 will operate to engage the web guide roller 9 with the drive shaft 11 so that the guide roller 9 will continue to turn and will exert a pulling force on the paper web 1 downstream of the first gripping location 2. This will assure that the leading end of the now severed or torn paper web 1 will be transported by the web guide roller 9 and the upstream cylinder pair 7 and 8 and will not wrap around the cylinders in the cylinder pair 7 and 8.

These cylinders 7 and 8 may now be safely stopped without web accumulation.

The speed difference between the web guide roller 9 and its associated drive shaft 11 will, during the normal operational mode, be in the range of 0.2% to 1.5%. This rotational differential is fixed in advance and in accordance with a selected value. The rotational speed of the web guide roller 9 will, in normal operations, be higher than the rotational speed of the guide roller drive shaft 11. Both the web guide roller 9 and the drive shaft 11 rotate in the same direction. As discussed above, if the rotational speed of the web guide roller 9 is reduced because of a tear of the material web 1 between the conveying gripping location 2 and the pulling gripping location 3, but downstream of the intermediate gripping location 13 formed by the "draw-off device" of guide roller 9 and pressure rollers 12, the direction switched coupling 24 will take over and will drive the web guide roller 9 at the speed of the guide roller drive shaft 11.

If the material web 1 should become wound on the surface of the web guide roller 9 while the drive shaft 11 and the guide roller 9 are connected by the direction switched coupling 24, the effective diameter of the web guide roller 9 will increase. This will increase the effective transport speed of the material web 1 downstream from the first gripping location 2 at cylinders 7 and 8. Such an increase in effective material web transport speed could result in further tearing of the web between the upstream gripping locations 2 and the intermediate gripping location 13. This is prevented by operation of the torque switched coupling 21. This coupling 21 will interrupt the connection between the shaft 11 and the drive force transmitting device, such as the intermediate wheel 22 when the defined torque is exceeded. This torque must be less than the maximally permissible torque on the web guide cylinder 9 which results from the tear resistance of the material web. In accordance with the present invention, the torque switched coupling 21 is embodied as a non-positive switch coupling, for example as a friction disc coupling.

Figure 3:
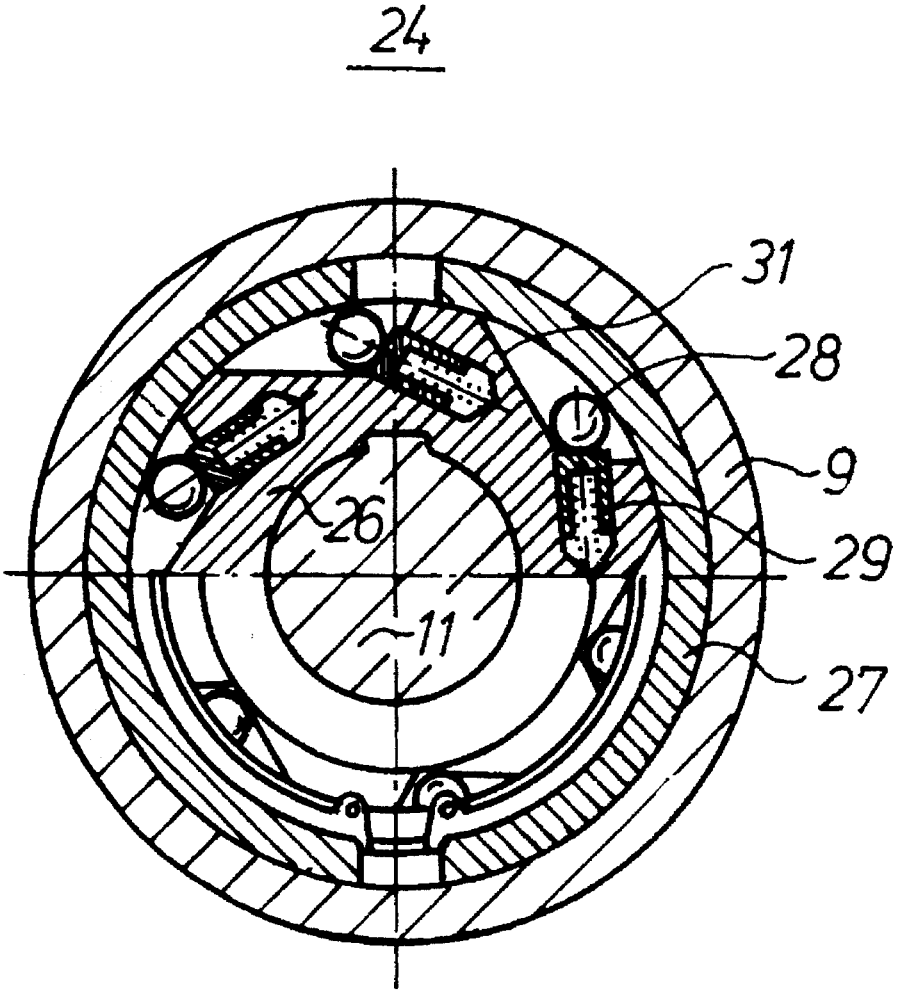
FIG. 3 is an end view, partly in cross-section, of the web guide roller of the present invention and showing the directionally switched coupling for the web guide roller.

A preferred embodiment of a direction switched coupling 24 in accordance with the present invention may be seen by referring primarily to FIG. 3. As may be seen, the web guide roller drive shaft 11 is keyed for rotation to an encircling driving element 26 which is depicted as a driving spring holder. In normal operation this driving spring holder or driving element 26 rotates with drive shaft 11 at a speed which is less than the rotational speed of a power take-off ring 27 that is formed as a part of or is connected to an inner surface of the outer cylindrical shell of the guide roller 9. The driving element 26 has a plurality of axially extended, somewhat triangular in cross-sectional shape, grooves. Each of these grooves receives an axially extending gripper roller 28. The driving element 26 is also provided with a plurality of springs 29 which are received in blind bores in the generally radially extending faces of the triangular grooves. With the drive shaft 11, its associated driving element 26, the power take-off ring 27 and the outer surface of the web guide roller 9 all turning in the same direction, and with the speed of the power take-off ring 27 and the outer shell of the roller 9 being greater than that of the drive shaft 11 and its associated driving element 26, the gripping rollers 28 will be carried into the deep ends of the triangular grooves so that the are pushed against the springs 29. In this normal operation orientation, the power take-off ring 27 and the outer shell of the guide roller 9 are driven by frictional contact with the tensioned paper web 1. Should the paper web 1 break or tear, as has been discussed above, the rotational speed of the outer shell of the guide roller 9 and thus the rotational speed of the power take-off ring 27 will be reduced. When this occurs the gripping rollers 28 will be forced by the springs 29 along the wedge surfaces 31 of the triangular grooves and will form a positive drive coupling between the driving element 26 and the power take-off ring 27. This will insure that the web guide roller 9 will continue to rotate at the speed of the drive shaft 11. The now torn material web 1 will now be conveyed between the conveying gripping location 2 and the intermediate gripping location 13 and will not wind up on the cylinders at the gripping location 2.

While not specifically depicted, it will be understood that the web guide cylinder 9 could be seated on the frames 18 and 19 with the directionally switched coupling 24 being situated exteriorly of the side frame 19 on an end of the drive shaft 11 which is now rigidly connected with the web guide cylinder 9. The directionally switched coupling 24 would still operate in the same manner but its location would be changed. It would also be possible to provide the drive train 22, 23 and 25 to the torque controlled coupling as an RPM controlled drive, such as an electric, pneumatic, or hydraulic drive whose speed of rotation would be set by an RPM transmitter, such as an angle coder or shaft encoder coupled to one of the rotating cylinders 7 and 8 of the first or upstream gripping locations.

While a preferred embodiment of a torn material web damage prevention device in accordance with the present invention has been set forth fully and completely hereinabove, it will be apparent to one of skill in the art that a number of changes in, for example the overall sizes of the cylinders, the main press drive assembly, the width of the material web and the like could be made without departing from the true spirit and scope of the present invention which is accordingly to be limited only by the following claims.

What is claimed is:

1. A device for preventing damage to a production apparatus with rotating cylinders including blanket cylinders in a web fed rotary printing press, said device comprising:

a first material web gripping location;

a second material web gripping location positioned downstream in a direction of material web travel from said first material web gripping location;

a rotatably supported material web guide roller positioned intermediate said first and second material web gripping locations and being rotated in a first direction and at a first rotational speed by a material web passing around said web guide roller;

a rotatably supported driven shaft driven in said first direction and at a second rotational speed less than said first rotational speed and rotatably supporting said web guide roller; and a directionally switched coupling selectively operable in response to a break in a material web intermediate said material web guide roller and said second material web gripping location and a resultant decrease in rotational speed of said material web guide roller from said first speed to said second speed to drivingly couple said driven shaft to said web guide roller.

2. The device of claim 1 wherein said web guide roller is hollow and further wherein said directionally switched coupling is disposed within said hollow web guide roller.

3. The device of claim 2 wherein said directionally switched coupling includes a power take off ring in said hollow web guide cylinder, a driving element secured to said driven shaft and a plurality of intermediate gripping rollers.

4. The device of claim 3 wherein said power take-off ring is secured to an inner surface of said hollow web guide cylinder.

5. The device of claim 1 wherein said second rotational speed is between 0.2% to 1.5% less than said first rotational speed.

6. The device in accordance with claim 1 further including a torque switching coupling connecting said driven shaft to a main drive of said web fed rotary printing press.

7. The device of claim 1 further including a plurality of spaced pressure rollers contacting an outer surface of said web guide roller.

8. The device of claim 7 further including a plurality of spaced lever arms and wherein each of said spaced pressure rollers is supported at a first end of a corresponding one of said lever arms.

9. The device of claim 8 further including a plurality of pneumatic cylinders wherein each of said lever arms is forced toward said web guide roller by one of said plurality of pneumatic cylinders.

* * * * *